United States Patent [19]

Maness

[11] 4,324,234

[45] Apr. 13, 1982

[54] DUAL CHAMBER PERSONAL FLOTATION DEVICE

[76] Inventor: Samuel G. Maness, 13008 Sturbridge Rd., Woodbridge, Va. 22192

[21] Appl. No.: 152,002

[22] Filed: May 21, 1980

[51] Int. Cl.[3] ..... A62B 7/00; B63C 11/00

[52] U.S. Cl. ..... 128/202.14; 128/207.16; 128/205.13; 441/123

[58] Field of Search ..... 128/202.14, 205.17, 128/205.24, 205.13, 202.19; 9/316, 342, 337; 251/297, 321, 325

[56] References Cited

U.S. PATENT DOCUMENTS

| | | | |
|---|---|---|---|
| 2,001,673 | 5/1935 | Davis | 128/202.14 |
| 2,456,130 | 12/1948 | Lambertsen | 128/202.19 |
| 3,266,070 | 8/1966 | O'Link | 9/342 |
| 3,536,071 | 10/1970 | Ferrando | 128/202.14 |
| 3,609,783 | 10/1971 | Cooke | 128/202.14 |
| 3,814,091 | 6/1974 | Henkin | 128/205.17 |
| 4,097,947 | 7/1978 | Kiefer | 9/342 |

FOREIGN PATENT DOCUMENTS

| | | | |
|---|---|---|---|
| 585931 | 10/1933 | Fed. Rep. of Germany | 251/354 |
| 279242 | 11/1964 | Netherlands | 128/202.13 |
| 6407645 | 1/1965 | Netherlands | 9/342 |

*Primary Examiner*—Henry J. Recla

*Attorney, Agent, or Firm*—Otto M. Wildensteiner; Harold P. Deeley, Jr.

[57] ABSTRACT

A dual chamber personal flotation device which allows rebreathing into it. One of the chambers is for flotation only and is inflated with $CO_2$; the other is for rebreathing, and is inflated with air. A tube located close to the wearer's mouth has a combination mouthpiece-shutoff valve on it which is designed to collect a minimum amount of water in it prior to being inserted in the wearer's mouth, thereby minimizing problems due to water ingestion during rebreathing. The chambers are independently inflatable in the event that either the size or the buoyancy has to be minimized in order to escape.

2 Claims, 6 Drawing Figures

DUAL CHAMBER PERSONAL FLOTATION DEVICEcl STATEMENT OF GOVERNMENT INTEREST

The present invention was made by a government employee in the course of his job and may be made or used by or for the government of the United States without the payment of any royalties thereon or therefore.

BACKGROUND

The present invention arose in response to a situation that could not be met by existing equipment. Specifically, the situation was the ditching of helicopters, and subsequent capsizing, particularly in cold water.

It was found that when a helicopter ditched it almost immediately turned over, due to the weight of the engine and transmission on the top of the fuselage. Although the helicopter's flotation gear ketp it from sinking, the crewmen were trapped in the cockpit or cargo compartment and were immersed in approximately 6 feet of water. The pilot and co-pilot were quite often still strapped in their seats, not having had time to release themselves before ditching.

It was further found that in some ditchings several crewmen drowned when it seemed that they should have been able to escape. Tests then showed that because of the low temperature of the water the men could not hold their breath as long as they could in warmer water, hence the drownings. This was further compounded by the fact that some were strapped in, which presumably led to a slight panic and which in turn further reduced their ability to hold their breath.

Another problem with escaping from a ditched helicopter is that sometimes the person will have to swim downward to a small hatch and wiggle through it in order to get to the surface. This means that a conventional large personl flotation device, which as a large amount of positive buoyancy and bulk, can hamper the wearer in two ways; the buoyancy can inhibit his ability to swim downward to the hatch, and the bulk of the device can make it difficult to squeeze through the hatch once he gets to it. These facts added to the problems of being strapped into a seat and being immersed in cold water result in a situation that is much more severe than it would seem to be.

A helicopter is a relatively small vehicle, and the distance to be covered to escape from any point within it is very small. Thus an escape device does not need to contain more than two or three minutes of breathing capability, to allow the escaping person to fight off any panic that may set in. It also should be relatively small, and low in buoyancy, to allow the person to squeeze through a small escape hatch. However, it should also be large enough to keep a person afloat in case rescue is not very quick.

OBJECTS OF THE INVENTION

Accordingly, it is an object of the present invention to provide a personal flotation device that will allow the wearer to breathe from it.

It is a further object of the present invention to provide a personal flotation device that will not hamper the wearer's ability to swim downward and to squeeze through a small opening.

It is a further object to provide a personal flotation device that has the capability to support the wearer for a long period of time.

It is a further object to provide a personal flotation device that does not cause discomfort when worn for a long period of time.

SUMMARY OF THE INVENTION

Briefly, the present invention is a personal flotation device having two separate chambers; one is inflated from a cartridge of compressed air, or other breathable mixture, the other is inflated from a cartridge of $CO_2$. The air-filled chamber has a breathing tube attached to it so that the wearer can breathe (or re-breathe) from it; the other chamber is for flotation only. Both chambers are made of flexible material so that the shape of the device can be changed to allow the wearer to squeeze through a narrow opening. Further, a special combination mouthpiece-shutoff valve is on the breathing tube; the valve was designed to collect a minimum amount of water in it before use to reduce the problem of water ingestion by the user.

DESCRIPTION OF THE PREFERRED EMBODIMENT

Figure 1:
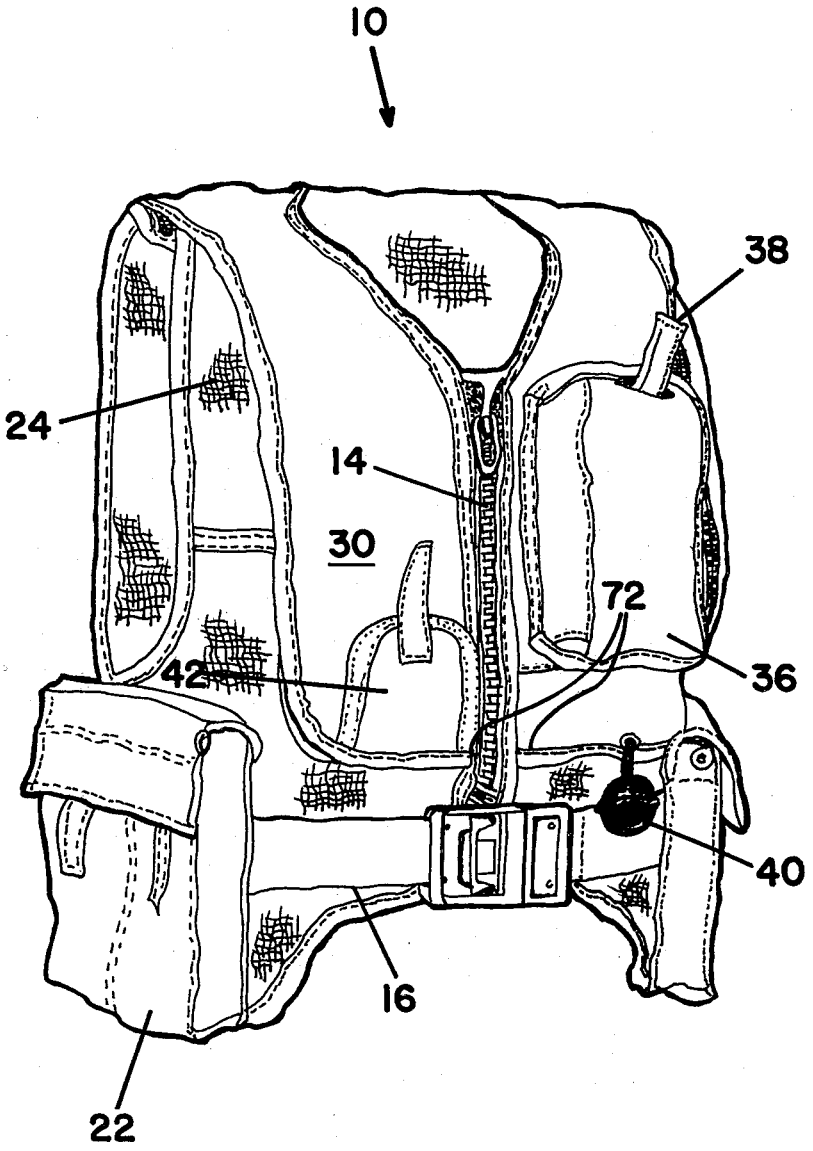
FIG. 1 is an overall view of the personal flotation device of the present invention.
Figure 2:
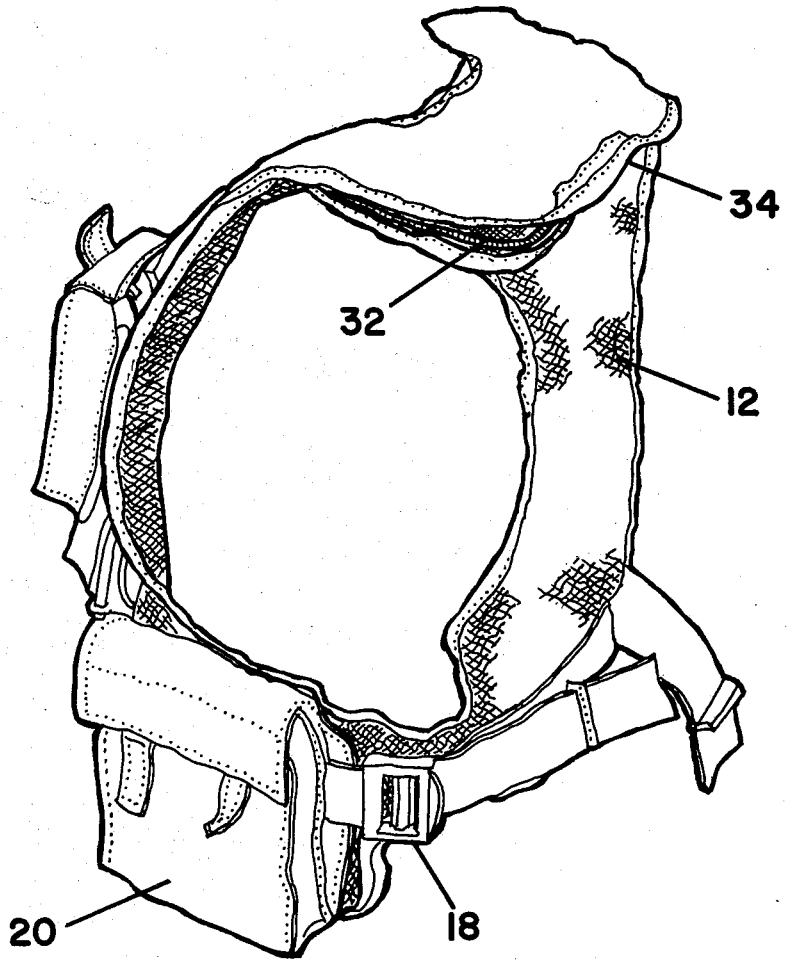
FIG. 2 is a side view of the personal flotation device of the present invention.

FIGS. 1 and 2 show the personal flotation device 10 of the present invention with the flotation cells uninflated. As can be seen, the device is a very compact package. The main body-encircling portion 12 of the device is made of nylon mesh; this allows air to circulate around the wearer's body, reducing heat buildup when wearing the device. The device is secured in front by zipper 14 and belt 16; to avoid the requirement of having to make several sizes of devices, belt 16 can be adjusted by means of sliding buckles 18 at the sides. Belt 16 can be cinched up tightly enough to keep the device from riding up the wearer's torso, thereby obviating the need for a set of crotch straps. The lack of crotch straps plus the fact that air can circulate through the nylon mesh make the device comfortable when worn on long missions over water. All items that are necessary to use of the device as a piece of survival gear are stowed in pouches or pockets that are covered but which are easily opened; these pouches or pockets are preferably made of woven nylon fabric in order to get maximum strength and durability with minimum overall weight. Pockets 20 are used for miscellaneous survival gear; pocket 22 contains the emergency radio, the antenna of which fits under flap 24 so that the radio is completely operative at all times. Flotation cells 26 and 28 (see FIG. 3) are stowed in main pouch 30, which is held in place by means of a separating zipper 32 at each side that has a removable slider; the central portion 34 at the top is held in place by means of a strip of Velcro or by snaps. When the cell or cells are inflated the pressure of the inflated cell separates the Velcro or snaps first, then as the cell inflates more it causes the zippers to separate and the outside of pouch 30 detaches from the rest of the device and the cell or cells are free to expand as shown in FIG. 4. Pouch 36 covers the rebreather tube and is fitted with pull tab 38; it is held to main pouch 30 by Velcro or snaps so that a tug on pull tab 38 lifts it off and rebreather tube 39 springs up into place as shown in FIG. 4.

Lanyard 40 is the only loose piece that hangs from the device when it is not in use; this lanyard is the means by which the air cell is inflated. A similar lanyard is attached to the $CO_2$-inflating cylinder; this is covered by pouch 42 so that it cannot be pulled accidentally in an emergency. Pulling on either lanyard fills one of the cells with that particular gas, as is well known in the art.

Figure 3:
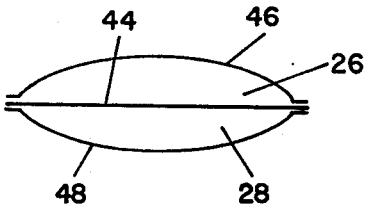
FIG. 3 is a cross section of the inflatable chambers of the device of the present invention.
Figure 4:
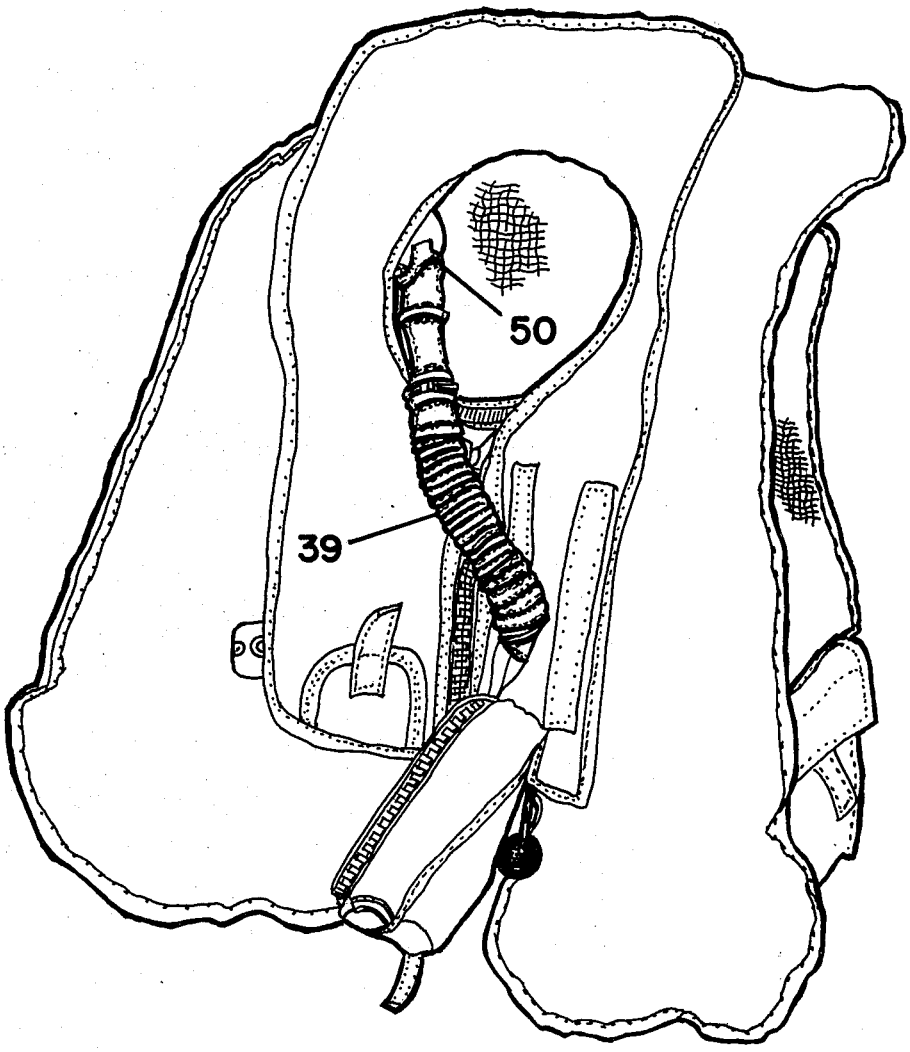
FIG. 4 shows the device of the present invention with the chambers fully inflated.

FIG. 3 shows a cross section of the cells of the device of the present invention with both cells inflated equally. As can be seen, there is a urethane membrane 44 between outer members 46 and 48, which are made of urethane-coated nylon. The three layers are heat welded together at their outer peripheries to form two cells separated by a flexible and elastic membrane. It is desirable that the separating membrane be elastic because when only one cell is inflated, the membrane can flex to the opposite sidewall and the effective volume of the cell will then be the whole device, rather than just one half as is shown in FIG. 3. The cells are fastened to the body-encircling portion 12 by stitching or any other means.

FIG. 4 shows the device with both cells inflated; as can be seen there are two large lobes which extend down to the region of the waist, which provide buoyancy for the desired flotation characteristic and righting moment. There is also an inflated collar behind the neck; this keeps the head of the wearer out of the water if the wearer should become unconscious, as is well known in the art. The device with maximum flotation (i.e., with the $CO_2$ cell fully inflated) exceeds the flotation requirements for a Coast Guard type 1 flotation device.

Figure 5A:
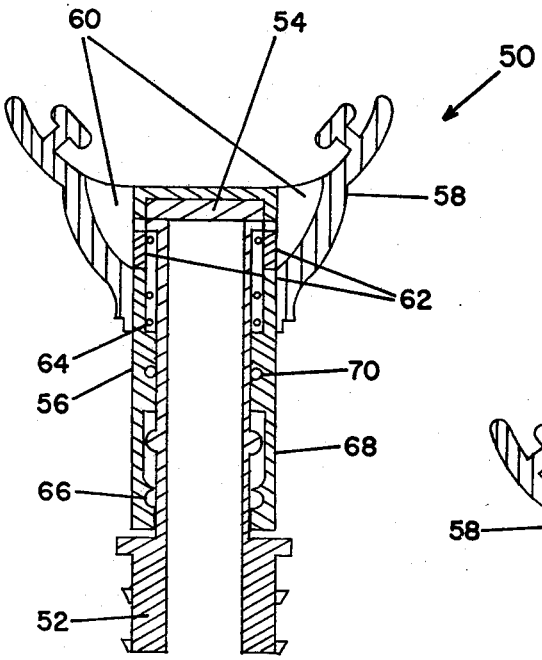
FIG. 5*a* and 5*b* show the mouthpiece valve of the device of the present invention in the closed and use positions respectively.
Figure 5B:
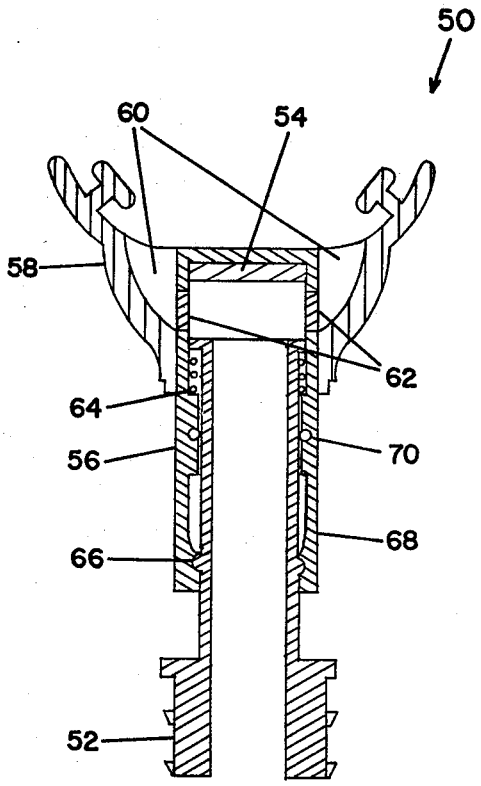

FIG. 5*a* shows the mouthpiece valve 50 that is attached to rebreather tube 39 in the closed position and FIG. 5*b* shows it in the open, or use, position. Mouthpiece valve 50 comprises a base portion 52 that is attached to tube 39; in the closed position of FIG. 5*a* the upper end of base portion 52 seats against soft rubber seal 54 and no air flows through it. Surrounding base portion 52 is outer member 56 to which is attached mouthpiece 58. Mouthpiece 58 has channels 60 which communicate with ports 62 in outer member 56. When outer member 56 is pulled up to the position shown in FIG. 5*b* air can flow from tube 39 through ports 62 and channels 60 into the wearer's lungs. Mouthpiece valve 50 is biased to the closed position by spring 64 and held in the use position by detents 66 on fingers 68. "O"-ring seal 70 prevents leakage when the mouthpiece valve is in use.

Mouthpiece valve 50 was specifically designed for the present application. It was found that the valve would in many instances be used when the wearer was upside down, hence it had to be designed to hold a minimum amount of water in it prior to use. The only places which will hold water after mouthpiece 58 is in the wearer's mouth are channels 60; this amount of water is so small it cannot be detected by the user.

The rebreathing side of the device is intended to not be completely filled when it is inflated. This is because a helicopter crewman who is attempting to escape from an overturned helicopter will usually have to move through the craft to an escape hatch to exit from the craft. A fully inflated device would have more buoyancy, making it difficult to do this; further, it would be more rigid than an underinflated device, and thus could pose problems in exiting through a small hatch. It was found that providing enough gas to produce approximately 25 pounds of buoyancy was the optimum, considering buoyancy, rigidity of the device, and quantity needed for breathing. Tests showed that a mixture of 50% nitrogen and 50% oxygen was good; as the oxygen became depleted the wearer began to breathe more frequently, which would help to prevent overinflation of the lungs during ascent.

The buoyancy chamber of the device is inflated with carbon dioxide, as is well known in the art. Since this chamber is not intended for use until the wearer is free of the helicopter, the considerations of excess buoyance and rigidity do not apply.

Operation and use of the device are as follows, assuming that one or both sides are inflated after having been used. The chambers are deflated so that they can be folded up and the spent inflation cartridges are replaced. As stated earlier, main pouch 30 which contains the chambers is held together by separating zippers 32 with removable sliders and by Velcro strips or snaps 34 at the top. The removable sliders are then slipped on and the zippers joined together at points 72 (FIG. 1). The deflated chambers are then folded up within main pouch 30 and each slider is brought up to the region of Velcro strips 34 where it is removed. At this time the zippers can be progressively separated back down to points 72, which would allow the deflated chambers to fall out; Velcro strips or snaps 34 keep the two halves of pouch 30 together at the top, which keeps the zippers from separating. Breathing tube 39 is then doubled over and pouch 36 put over it. The device is now ready fo use again.

To use the device, lanyard 40 is pulled to inflate the rebreathing chamber; this provides buoyancy as well as a rebreathing capability if such is desired. If rebreathing is desired the wearer pulls on tab 38 which removes pouch 36 and allows rebreather tube 39 to assume the position shown in FIG. 4. The wearer then puts mouthpiece 58 in his mouth and pulls on it so that the assembly is in the use position shown in FIG. 5B. If the wearer is upside down at this point the small amount of water in channels 60 will drain into his mouth and he will have to swallow it; if he is in any other position the water will drain into the rebreathing chamber where it will not pose any problems. The wearer can now rebreathe from three to five minutes from the device, which should provide ample time to escape from a ditched and overturned helicopter. Upon reaching the surface the wearer can activate the $CO_2$ flotation system if this is necessary.

Obviously the rebreathing chamber can be fitted with a device which inflates it automatically upon contact with water, as is well known in the art.

What is claimed is:

1. A dual chamber personal flotation device comprising: a flexible inflatable air-tight container designed to fit around the neck of the wearer; a flexible elastic air-tight membrane within said container dividing said container into two chambers; means for independently inflating said two chambers; and means for allowing the wearer to breathe the contents of one of said two chamber, said means for allowing the wearer to breathe the contents of one of said two chambers comprising a flexible tube attached at one end to said one chamber and having a combination mouthpiece-shutoff valve at its other end, said combination mouthpiece-shutoff valve comprising a stationary tubular central member, a sliding outer member surrounding said central member and capable of being in either an open or a closed position, a set of flow passages in said sliding outer member, sealing means in said outer member cooperating with said inner member to prevent flow through said flow passages when said outer member is in the closed position, and a mouthpiece on said outer member wherein said valve has means for urging said outer member to said closed position and means for holding said outer member in said open position.

2. A Flotation device as in claim 1 wherein said sealing means which prevents flow through said flow passages is immediately adjacent said mouthpiece.

* * * * *